US007922409B2

(12) United States Patent
Murahashi

(10) Patent No.: US 7,922,409 B2
(45) Date of Patent: Apr. 12, 2011

(54) PRINTER AND PRINTER CONTROL METHOD

(75) Inventor: Kenichi Murahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 560 days.

(21) Appl. No.: 11/728,000

(22) Filed: Mar. 27, 2007

(65) Prior Publication Data

US 2007/0231042 A1 Oct. 4, 2007

(30) Foreign Application Priority Data

Apr. 3, 2006 (JP) ..... 2006-102367

(51) Int. Cl.
*B41J 11/00* (2006.01)

(52) U.S. Cl. ..... 400/583; 400/76; 400/708; 347/104

(58) Field of Classification Search ..... 400/583
See application file for complete search history.

(56) References Cited

U.S. PATENT DOCUMENTS 4,354,766 A * 10/1982 Hendrischk et al. ..... 400/708
4,538,515 A * 9/1985 Tymkewicz et al. ..... 101/216
4,674,899 A * 6/1987 Kimura ..... 400/613
5,023,728 A * 6/1991 Nimura et al. ..... 347/104
5,988,905 A * 11/1999 Abe et al. ..... 400/613
6,755,583 B1 * 6/2004 Maruyama ..... 400/613

FOREIGN PATENT DOCUMENTS

| | | |
|---|---|---|
| JP | 06-115787 | 4/1994 |
| JP | 2003-335008 | 11/2003 |
| JP | 2004-223715 | 8/2004 |
| JP | 2006-026907 | 2/2006 |

* cited by examiner

*Primary Examiner* — Jill E Culler

(74) *Attorney, Agent, or Firm* — Michael T. Gabrik

(57) ABSTRACT

A printer which prints to a roll paper medium under the control of the printer and to a printer control method for maintaining consistently in high quality printing even at the end of a roll paper print medium. The printer conveys roll paper 11 through a paper transportation path and prints to the roll paper 11 using a print head 21 carried on a carriage 23 that moves transverse to the transportation path. When the trailing end 11*a* of the roll paper is detected, the printer advances and then stops the print medium so that the trailing end 11*a* of the roll paper is positioned on the transportation path outside of the carriage path 53.

4 Claims, 8 Drawing Sheets

PRINTER AND PRINTER CONTROL METHOD

BACKGROUND OF THE INVENTION

1. Technical Field

The present invention relates to a printer and to a control method for the printer.

2. Related Art

Roll paper printers such as receipt printers and coupon printers that print images while conveying a print medium from a roll through a media transportation path are known from the literature. Printers of this type index the roll paper from the roll to the printing start position by means of a paper transportation mechanism including paper transportation rollers, and then print an image according to the print data while advancing the roll paper at a predetermined speed.

If the roll paper runs out while working, this type of receipt printer or coupon printer cannot correctly print the print data to be printed, the queue of receipts or coupons to be printed continues to grow, and work cannot proceed efficiently. The paper also curls tightly toward the inside diameter end of the roll, and the paper cannot be smoothly discharged at the very end of the roll due to the tight paper curls. Curled receipts and coupons are also unsightly and difficult to use.

To avoid such problems Japanese Unexamined Patent Appl. Pub. JP-A-H06-115787 teaches a printer that has a strain gauge in the bottom of the roll paper holder and displays how much roll paper remains in three stages according to the strain that is indicated by the strain gauge according to how much roll paper remains in order to keep the user informed of how much roll paper remains.

Japanese Unexamined Patent Appl. Pub. JP-A-2004-223715 teaches a printer that applies tension, which is determined, by how much roll paper remains, in the opposite direction as the direction in which the roll paper curls in order to remove the unwanted curling.

Various printers that execute particular operations depending on the remaining amount of roll paper are thus known from the literature. However, while tension can be applied to remove curling as described in Japanese Unexamined Patent Appl. Pub. JP-A-2004-223715, when there is very little roll paper remaining and the trailing end of the roll paper separates from the core, tension cannot be applied to the roll paper because the trailing end is free. As a result it may not be possible to remove curling near the trailing end of the roll paper.

As shown in FIG. 7 and FIG. 8, inkjet printers that print to roll paper by discharging ink from the nozzles of a print head typically have two transportation rollers 71 and 72 disposed on opposite sides of the path of the carriage 74 on which the print head is mounted. This printer stops paper transportation when the trailing end 76 of the roll paper is detected and moves the carriage to a standby position in order to cap the print head to prevent the ink in the nozzles of the print head mounted on the carriage 74 from drying out. If paper transportation is stopped immediately when the trailing end 76 of the roll paper is detected, the carriage 74 moves to the standby position while the trailing end 76 of the roll paper remains between the two transportation rollers 71 and 72 and is thus in the path of the carriage.

More specifically, when the roll paper 75 is loaded so that the paper unrolls in the counterclockwise direction (the direction of arrow x) as shown in FIG. 7A, the trailing end 76 of the roll paper dangles freely as shown in FIG. 7B.

When the roll paper 75 is loaded so that the paper unrolls in the clockwise direction (the direction of arrow y) as shown in FIG. 8A, the trailing end 76 of the roll paper may spring back as shown in FIG. 8B.

In both of the situations shown in FIG. 7B and FIG. 8B, however, the roll paper 75 is left to interfere with moving the carriage 74 to the standby position. In some cases this can cause a paper jam and printer malfunction. Furthermore, the ink meniscus in the nozzles can also be broken and consistent print quality cannot be maintained if the paper contacts the print head.

Furthermore, when the paper detector 73 detects the trailing end 76 of the roll paper 75 and the user installs a new roll of paper, it is preferable to remove the small amount of roll paper left in the transportation path to avoid a paper jam.

SUMMARY

The printer and printer control method according to the present invention prevent paper jams and other problems caused by carriage movement after the trailing end of a roll of a print medium is detected, and prevent variation in print quality caused by the print medium contacting the print head when the carriage moves.

A printer according to a first aspect of the invention has a transportation mechanism for conveying a rolled print medium through a transportation path; a print head for printing images on the print medium; a carriage for carrying the print head and transversing the transportation path with the print head; a paper detector for detecting the trailing end of the print medium; and a drive control unit for controlling driving the transportation mechanism and the carriage. When the paper detector detects the trailing end of the print medium, the drive control unit advances and then stops the print medium so that the trailing end of the print medium is positioned on the transportation path outside the path of carriage movement.

Preferably, the transportation mechanism has first transportation rollers disposed on the upstream side of the carriage path, and when the paper detector detects the trailing end of the print medium, the drive control unit advances and then stops the print medium with the print medium held by the first transportation rollers.

Yet further preferably, the transportation mechanism has second transportation rollers disposed on the downstream side of the carriage path; and when the paper detector detects the trailing end of the print medium, the drive control unit advances and then stops the print medium at a position where the print medium is held by the second transportation rollers on the downstream side of the carriage path.

Yet further preferably, when the paper detects the trailing end of the print medium, the drive control unit advances and then stops the print medium at a position where the print medium is held by the first transportation rollers, then moves the carriage to a standby position outside the paper transportation path, and then advances and stops the print medium at a position where the print medium is held by the second transportation rollers.

Another aspect of the invention is a control method for a printer that prints images on a print medium by conveying a rolled print medium through a transportation path and driving a print head carried on a carriage that moves transversely to the transportation path, the control method having steps of detecting the trailing end of the print medium; and advancing and then stopping the print medium so that the trailing end of the print medium is positioned on the transportation path outside the path of carriage movement after the trailing end of the print medium is detected.

Preferably, when the trailing end of the print medium is detected, the print medium is advanced and then stopped with the print medium held by first transportation rollers disposed on the upstream side of the path of carriage movement.

Further preferably, when the trailing end of the print medium is detected, the print medium is advanced and then stopped with the print medium on the downstream side of the carriage path and held by second transportation rollers disposed on the downstream side of the carriage path.

Yet further preferably, when the trailing end of the print medium is detected, the print medium is advanced and stopped at a position where the print medium is held by the first transportation rollers, the carriage is then moved to a standby position outside the paper transportation path, and the print medium is then advanced and stopped at a position where the trailing end of the print medium is held by the second transportation rollers.

When the trailing end of the roll paper print medium is detected, the printer and the printer control method of the invention advance the print medium until the trailing end of the paper is positioned outside the path of carriage movement. The trailing end of the paper is therefore not left in the carriage path when the carriage is moved after the trailing end of the roll paper is detected. The trailing end of the roll paper therefore does not contact the carriage, and the trailing end of even tightly curled paper will not interfere with carriage movement.

When the trailing end of the roll paper print medium is detected, the printer and the printer control method of the invention advance and then stop the print medium with the print medium held by first transportation rollers disposed on the upstream side of the path of carriage movement. More specifically, the trailing end of the print medium is either held between the first transportation rollers or is on the upstream side of the first transportation rollers. Tension is thus applied to the portion of the print medium downstream from the first transportation rollers, and even a tightly curled print medium does not spring into the carriage path. The print medium therefore will not contact the carriage when the carriage moves, paper jams and other problems caused by contact with the print medium can be prevented, and printer breakdowns can be avoided.

When the trailing end of the roll paper print medium is detected, the printer and the printer control method of the invention advance and then stop the print medium with the print medium held on the downstream side of the carriage path by second transportation rollers located on the downstream side of the carriage path. Because the print medium is also positioned on the downstream side of the carriage path in this case, there is no contact between the carriage and the print medium if the carriage is moved. Paper jams can therefore be prevented. In addition, because the second transportation rollers hold the print medium even when the remaining print medium is very short, the user can smoothly replace the print medium without the print medium left in the transportation path falling out when the print medium is replaced.

When the trailing end of the roll paper print medium is detected, the printer and the printer control method of the invention hold the print medium with the first transportation rollers, then move the carriage to a standby position outside the paper transportation path, and then advance and stop the print medium with the trailing end of the print medium held by the second transportation rollers. As a result, if the carriage is not at the standby position when the trailing end of the roll paper is detected, the print medium is first gripped by the first transportation rollers and the carriage is moved to the standby position with tension applied to the print medium. Moving the carriage will therefore not cause a paper jam and the print medium will not contact the surface of the print head carried on the carriage. The ink meniscus in the nozzles will therefore not be disturbed and print quality can be maintained. The nozzles of the print head can also be protected because the carriage is quickly moved to the standby position before the trailing end of the roll paper is gripped by the second transportation rollers. Furthermore, because transportation stops completely when the trailing end of the roll paper is held by the second transportation rollers, the short remaining end of the print medium can be left inside the transportation path without the paper falling out from the printer. The user can also easily remove this remaining end and install a new roll of paper because only the trailing end of the paper is held by the transportation rollers.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of a printer and a printer control method according to the present invention are described below with reference to the accompanying figures. The printer described in the preferred embodiment of the invention is an inkjet printer that prints by placing ink on a print medium, is communicably connected to a host computer, and prints according to commands and print data sent from the host computer.

Figure 1:
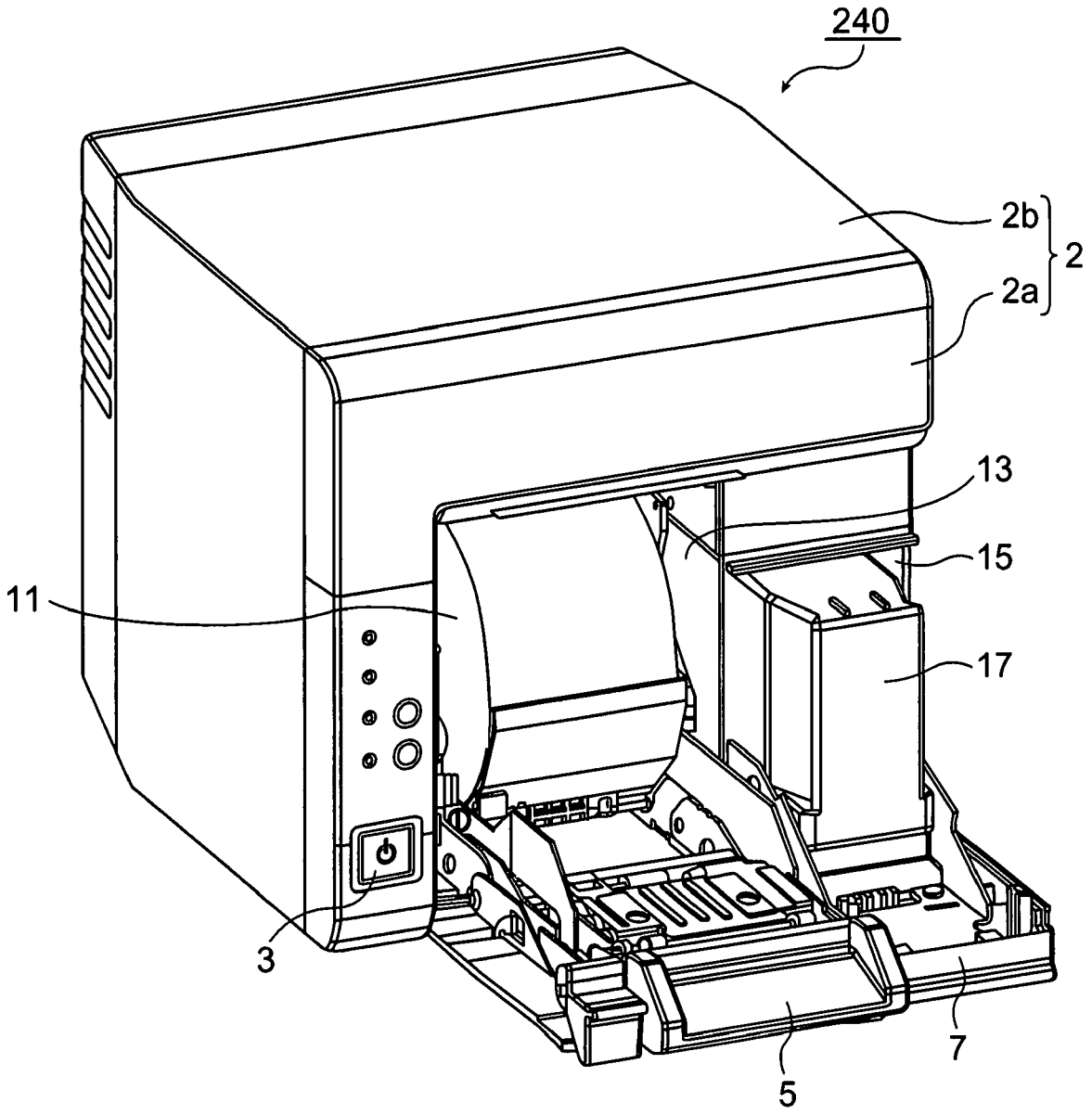
FIG. 1 is an external oblique view of a printer according to a preferred embodiment of the invention with the two front covers open for accessing the inside of the printer.
Figure 2:
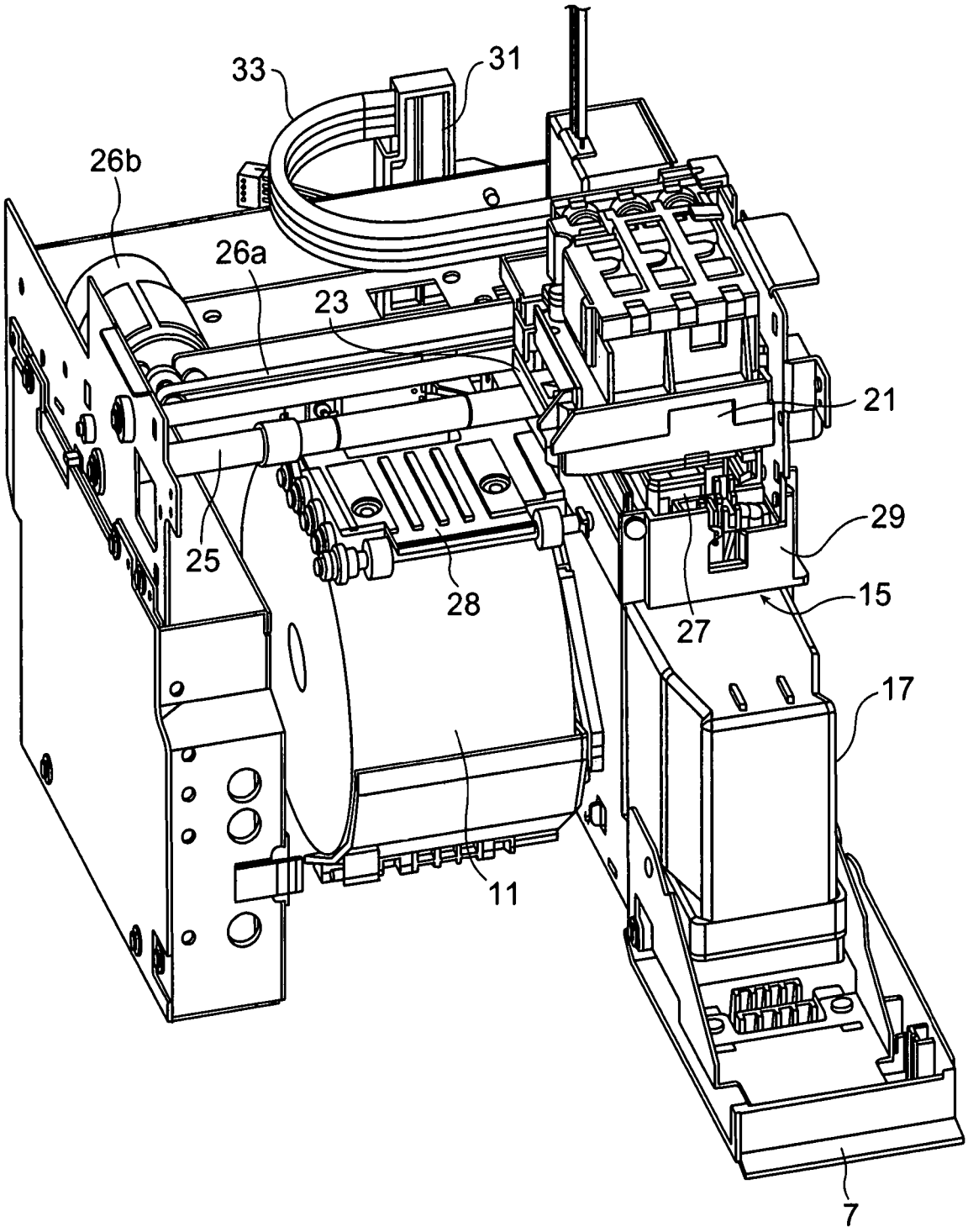
FIG. 2 is an external oblique view of the printer shown in FIG. 1 with the printer case removed.

FIG. 1 is an external oblique view of a printer according to a preferred embodiment of the invention with the two front covers open for accessing the inside of the printer. FIG. 2 is an external oblique view of the printer shown in FIG. 1 with the printer case removed.

Printer Arrangement

A printer 240 according to this embodiment of the invention is described below.

The printer 240 according to this embodiment of the invention is a printer for printing coupons by recording images on roll paper 11 used as the print medium using plural colors of ink.

The printer 240 has from the left a power switch 3, a roll paper cover 5, and an ink cartridge compartment cover 7 disposed at the front of the printer case 2, which includes a front top panel 2*a* and a case cover 2*b*. LED indicators 6 for reporting the printer 240 or host computer 220 status to the user are disposed above the power switch 3. The roll paper cover 5 and ink cartridge compartment cover 7 that are the front covers can swing on a hinge not shown disposed at the bottom to open and close to the front of the printer.

Opening the roll paper cover 5 opens the paper compartment 13 where the roll paper 11 used for printing is held, and thus enables replacing the roll paper 11. Opening the ink cartridge compartment cover 7 similarly opens the ink cartridge compartment 15 so that the ink cartridge 17 can be loaded and removed.

The ink cartridge 17 is a package containing three color ink packs for yellow, cyan, and magenta inside a cartridge case. Opening and closing the ink cartridge compartment cover 7 in the printer 240 according to this embodiment of the invention also causes the ink cartridge 17 to slide in the ink cartridge compartment 15 from the cartridge replacement position to the printing position, or from the printing position to the cartridge replacement position.

A carriage 23 that carries a print head 21 having nozzles for discharging ink is located above the roll paper compartment 13 inside the printer case 2 as shown in FIG. 2. The carriage 23 is supported movably across the width of the paper by a guide member 25 extending widthwise to the roll paper 11, and can be moved bidirectionally widthwise to the roll paper 11 above the platen 28 by a endless belt 26*a* disposed widthwise to the roll paper 11 and a carriage motor 26*b* that drives the endless belt 26*a*.

The path formed by the carriage 23 moving widthwise to the paper on the guide member 25 is referred to below as the "carriage path 53" (see FIG. 5).

The standby position of the bidirectionally moving carriage 23 is located above the ink cartridge compartment 15. A cap 27 and an ink suction unit 29 are disposed below this standby position. The cap 27 covers the nozzles of the print head 21 that are exposed below the carriage 23, and the ink suction unit 29 removes high viscosity ink from the nozzles of the print head 21 and air bubbles from inside the ink supply tube 33 and other parts of the ink path 31 through the cap 27 by suction.

Relationship Between the Host Computer and Printer

The relationship between the host computer 220 and the printer 240 in this embodiment of the invention is described next with reference to FIG. 3.

Figure 3:
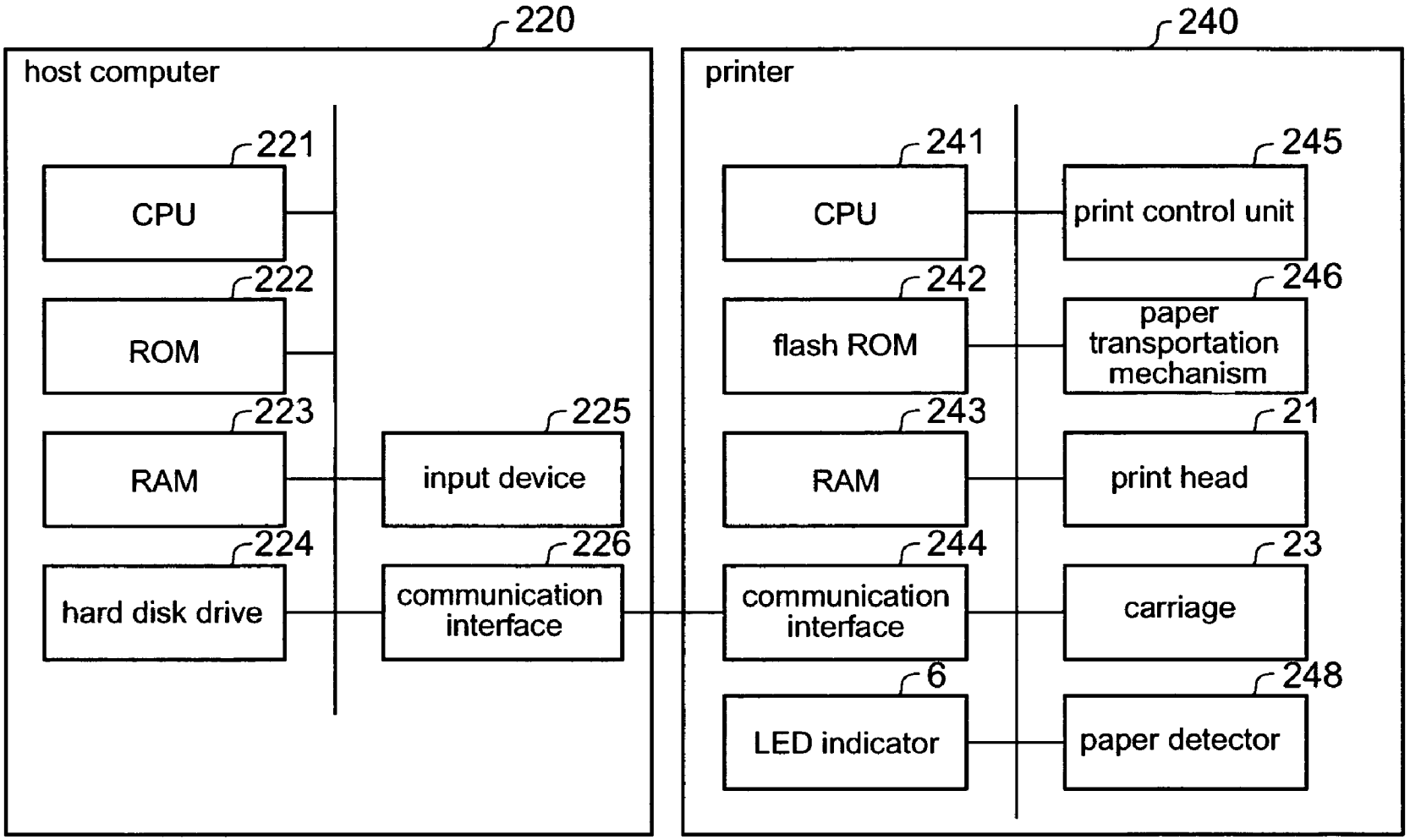
FIG. 3 is a block diagram showing the arrangement of the host computer and printer according to a preferred embodiment of the invention.

FIG. 3 is a block diagram showing the arrangement of the host computer 220 and printer 240. The printer 240 of the invention executes an output process according to the commands and print data sent from a communicably connected host computer 220.

As shown in FIG. 3, the host computer 220 has a CPU 221, ROM 222 as nonvolatile memory, RAM 223 as volatile memory, a hard disk drive 224 as a mass storage device, an input device 225, and a communication interface 226. The CPU 221 of the host computer 220 runs an operating system and application programs stored on the hard disk drive 224 while outputting commands and print data through the communication interface 226 to the printer 240 in order to control the printer 240.

The printer 240 has a CPU 241, flash ROM 242 as rewritable nonvolatile memory, RAM 243 as volatile memory, a communication interface 244, a print control unit 245 for recording images by causing the print head 21 to discharge ink onto the roll paper 11, a paper transportation mechanism 246 (transportation mechanism), the print head 21, the carriage 23, and a paper detector 248.

The printer 240 receives print data by communicating with the host computer 220 through the communication interface 244, as the CPU 241 runs firmware stored in the flash ROM 242. Based on the received commands and print data, the print control unit 245 causes the carriage 23 carrying the print head 21 to move along the carriage path 53 and causes the print head 21 to print on the roll paper 11 while driving the paper transportation mechanism 246 to convey the roll paper 11 through the transportation path. A coupon is printed as a result of this operation.

The paper transportation mechanism 246 has four transportation rollers including a pair of first transportation rollers 51*a* and 51*b* and a pair of second transportation rollers 52*a* and 52*b*, and a stepping motor not shown as the drive power source of these transportation rollers. The first transportation rollers 51*a* and 51*b* are disposed widthwise to the roll paper 11 on the upstream side of the carriage path 53, and the second transportation rollers 52*a* and 52*b* are disposed widthwise to the roll paper 11 on the downstream side of the carriage path 53. The roll paper 11 is disposed between and conveyed by these four transportation rollers. The position of the carriage 23 relative to the transportation rollers is further described below with reference to FIG. 5.

The paper detector 248 detects the leading end and trailing end of the roll paper by means of an optical sensor, for example. More specifically, the paper detector 248 detects the leading end of the roll paper to index the roll paper to the printing start position when a new roll of paper is loaded in the roll paper compartment 13, and detects the trailing end 11*a* of the roll paper when there is little remaining roll paper 11.

Roll Paper Transportation Process

Figure 4:
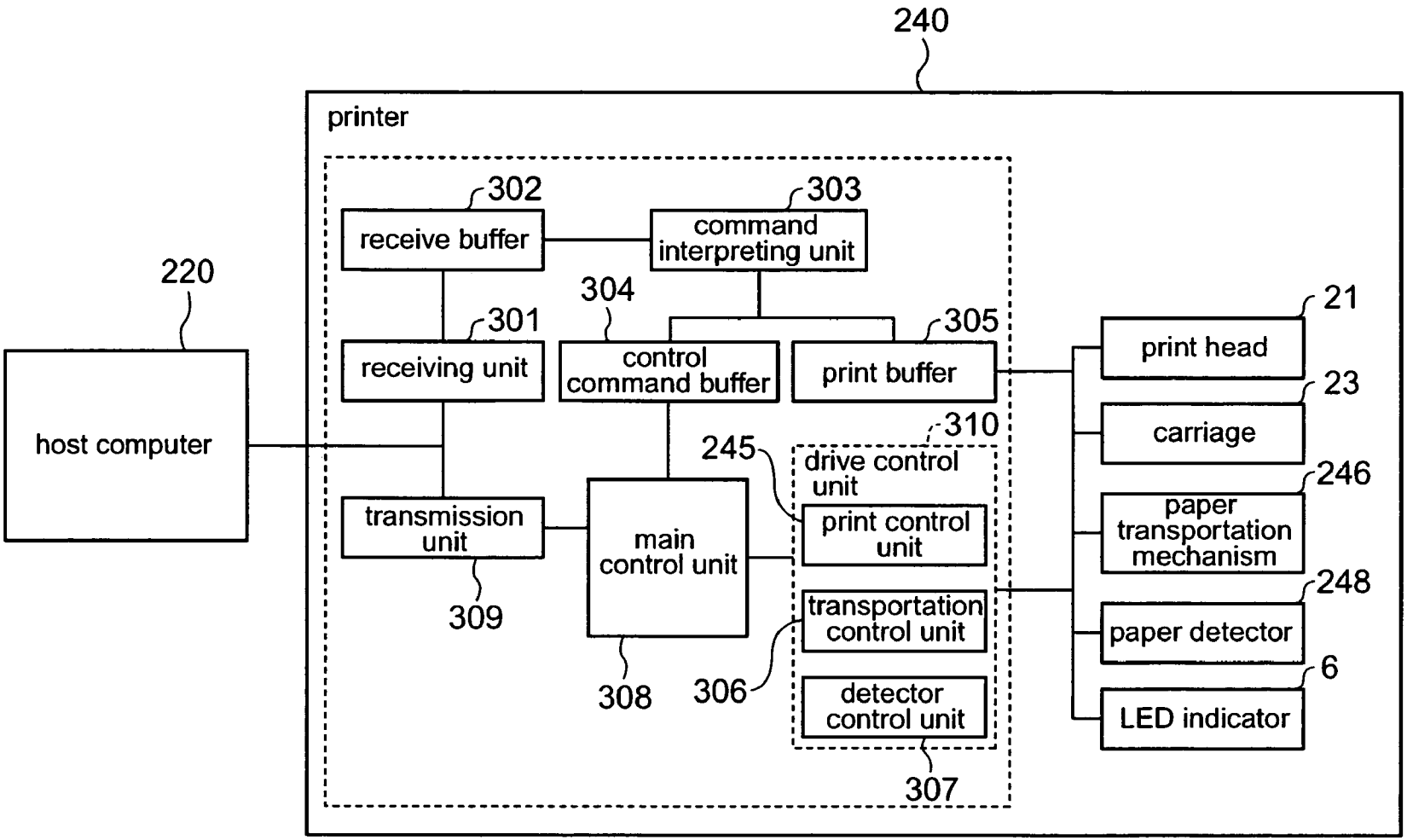
FIG. 4 is a function block diagram showing the internal process of the printer according to a preferred embodiment of the invention.

After the paper detector 248 detects the trailing end 11*a* of the roll paper, the printer 240 according to this embodiment of the invention advances the roll paper 11 to a position where the roll paper 11 will not interfere with movement of the carriage 23. How the roll paper 11 is conveyed after the paper detector 248 detects the trailing end 11*a* of the roll paper is described below. FIG. 4 is a function block diagram showing the internal process of the printer 240.

As shown in FIG. 4, a receiving unit 301 for receiving command and print data sent from the host computer 220, and a receive buffer 302 for temporarily storing the command and print data received by the receiving unit 301, are provided in the printer 240. The commands and print data received by the receive buffer 302 are interpreted by a command interpreting unit 303, which sends the control commands to the control command buffer 304 and sends the print data to the print buffer 305.

The control command data temporarily stored in the control command buffer 304 is read by the main control unit 308 to cut the roll paper and advance the roll paper as described below.

The print data temporarily stored in the print buffer 305 is converted by a data conversion process to dot pattern data conforming to the nozzle array of the print head 21 and stored in the print buffer 305.

A transportation control unit 306 and a detector control unit 307 function to execute the roll paper transportation process. The print control unit 245, the transportation control unit 306, and the detector control unit 307 together constitute the drive control unit 310 in this embodiment of the invention.

The print control unit 245 drives the carriage 23 and print head 21 based on print commands and print data from the host computer 220.

The transportation control unit 306 drives the paper transportation mechanism 246 according to transportation commands sent from the host computer 220. The detector control unit 307 controls operation of the paper detector 248 and causes an LED indicator 6 to light steady at a predetermined time when the paper detector 248 detects the trailing end 11*a* of the roll paper.

When the detector control unit 307 determines that the trailing end 11*a* of the roll paper was detected in this embodiment of the invention, the transportation control unit 306 controls driving the first transportation rollers 51*a* and 51*b* and the second transportation rollers 52*a* and 52*b* a specific distance and then stopping the transportation rollers. The print control unit 245 also drives the carriage 23 at a predetermined time so that the roll paper 11 does not interfere with moving the carriage 23 to the standby position.

Figure 5A:
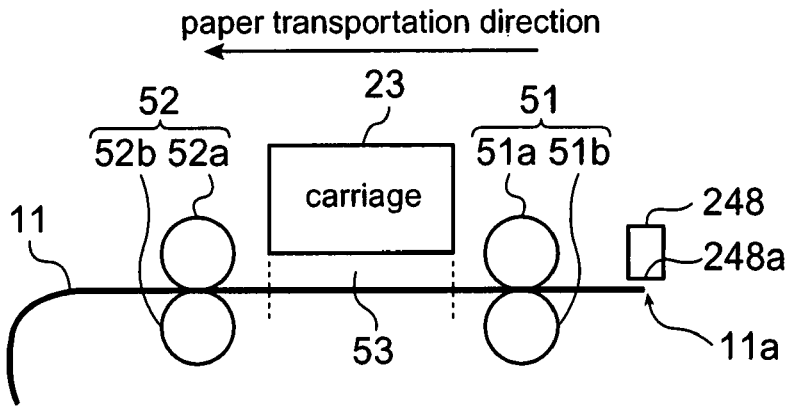
FIG. 5 is a schematic diagram showing the paper transportation process when the printer detects the trailing end of the roll paper in a preferred embodiment of the invention.
Figure 5B:
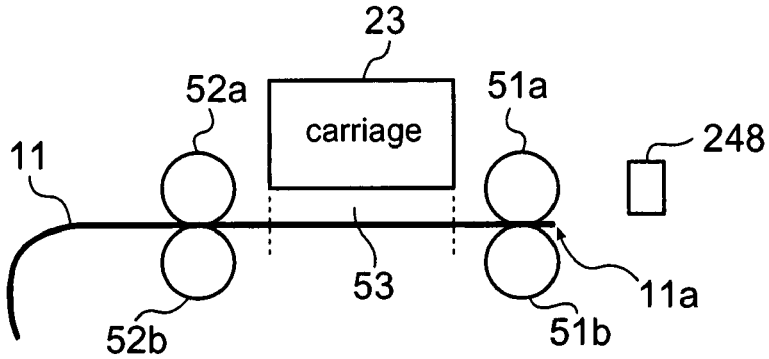
Figure 5C:
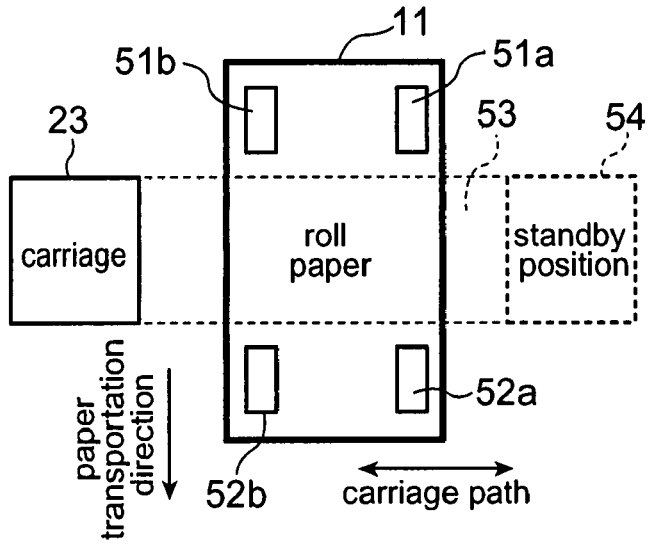
Figure 5D:
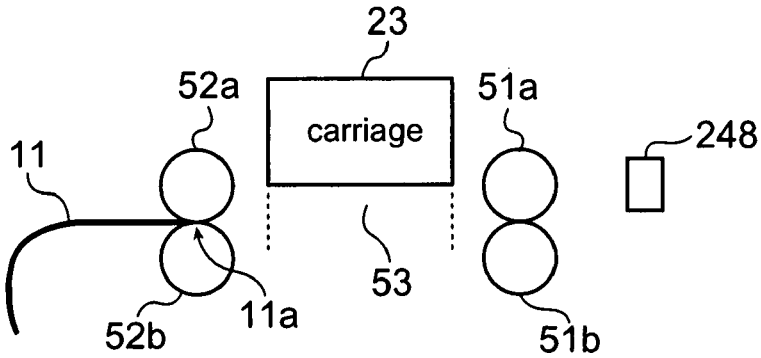

The relative positions of the carriage 23, the transportation rollers 51 and 52, and the paper detector 248 are described next with reference to FIG. 5. FIG. 5 is a schematic diagram describing the transportation process when the trailing end 11*a* of the roll paper is detected. FIG. 5A, FIG. 5B, and FIG. 5D are schematic section views of the roll paper transportation path, and FIG. 5C is a plan view of the transportation path.

Disposed along the transportation path in order from the upstream side of roll paper 11 transportation are the paper detector 248 for detecting the trailing end 11*a* of the roll paper, the first transportation rollers 51, the path 53 of carriage 23 movement, and the second transportation rollers 52 as shown in FIG. 5A.

Each time the carriage 23 scans the carriage path 53 once during the printing process, the print head 21 on the carriage 23 prints a band (one band) equal in width to the length of the nozzle array in the paper transportation direction. When printing one band is completed, the first transportation rollers 51 and second transportation rollers 52 are driven to advance the roll paper 11 a distance equal to the width of one band, and the carriage 23 then scans the carriage path 53 once again. This operation repeats to produce the desired printing result.

Figure 6:
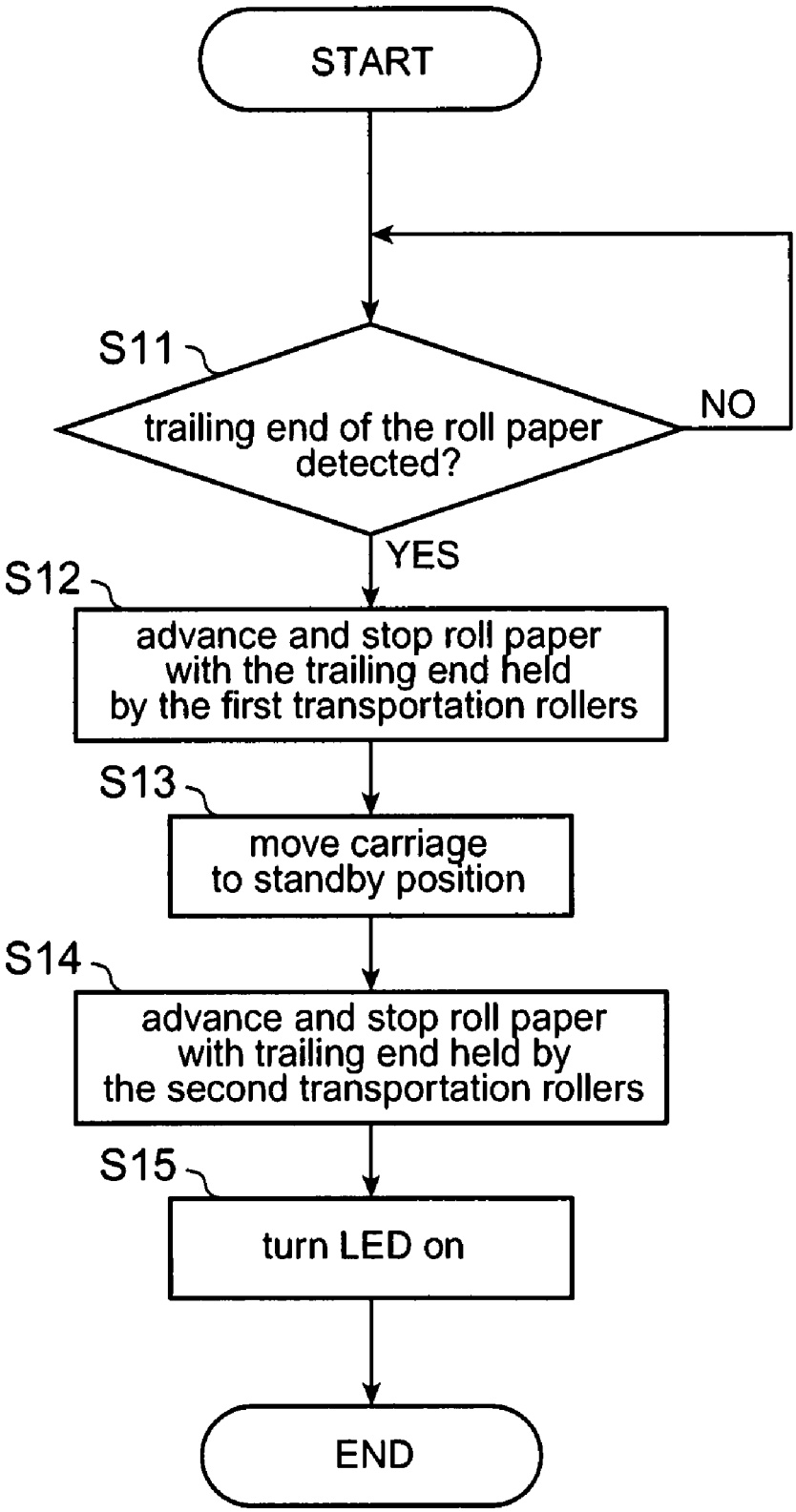
FIG. 6 is a flow chart describing the roll paper transportation process executed when the printer of the invention detects the trailing end of the roll paper.
Figure 7B:
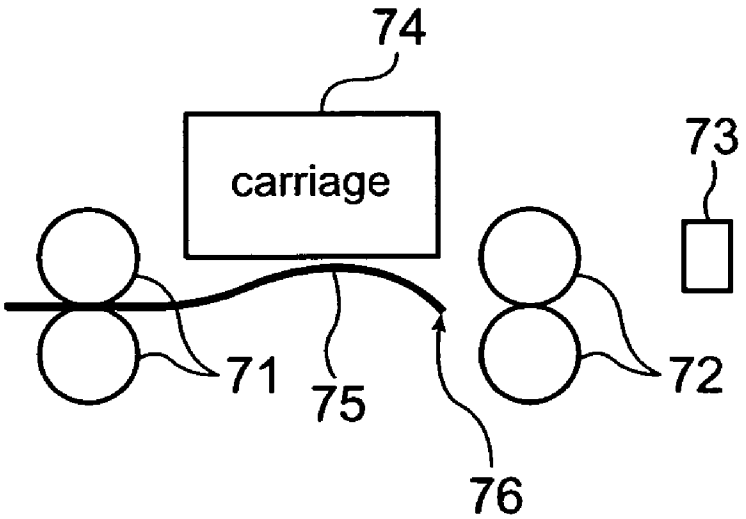
FIG. 7 is a schematic section view describing the roll paper transportation process of the related art.
Figure 7A:
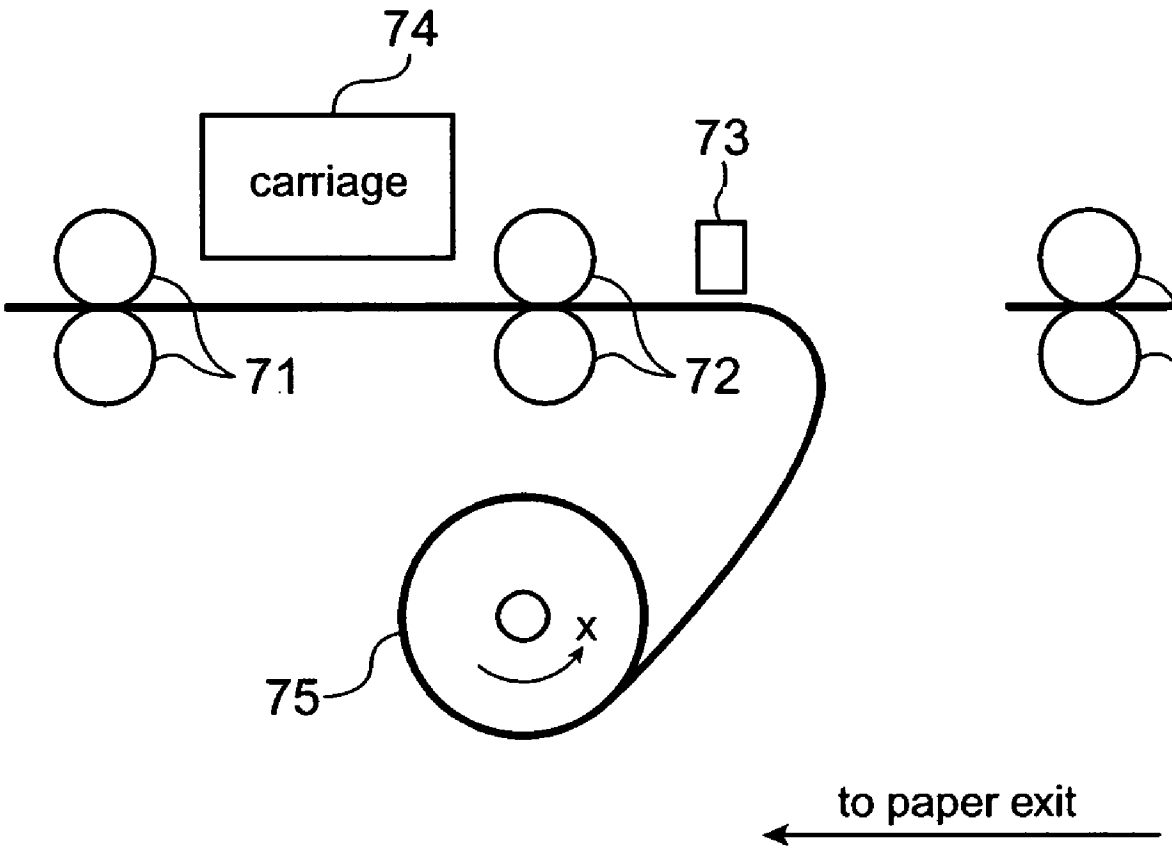
Figure 8B:
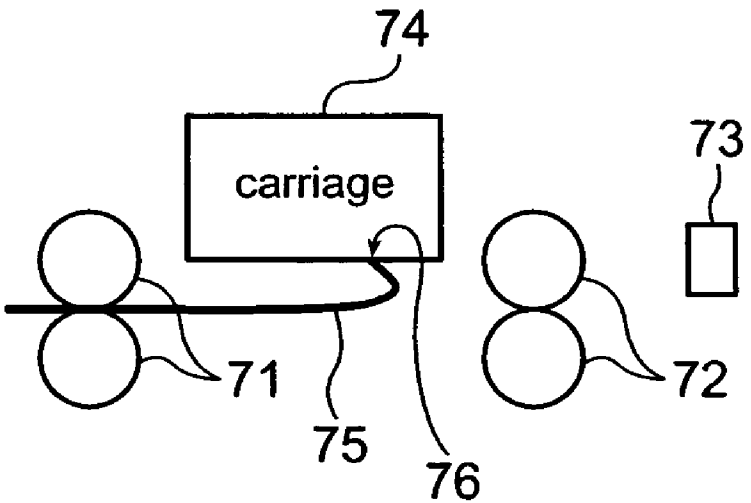
FIG. 8 is a schematic section view describing another example of the roll paper transportation process of the related art.
Figure 8A:
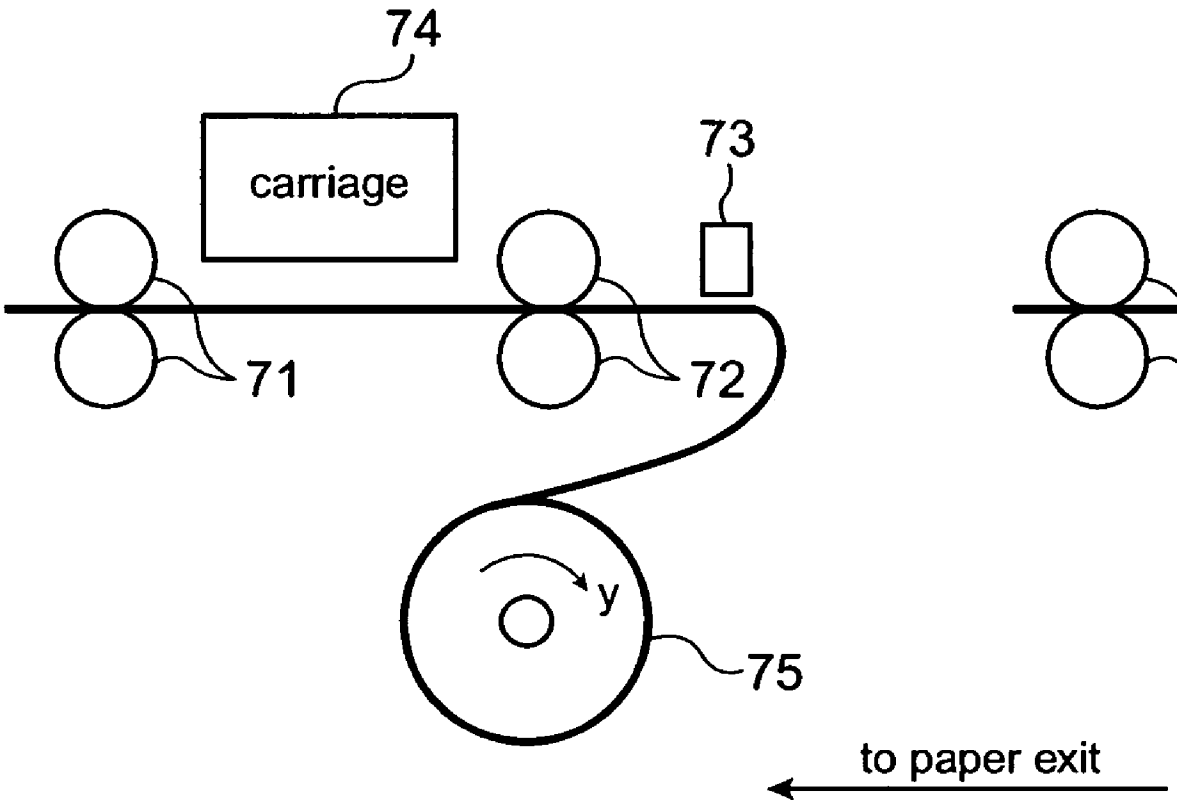

The roll paper transportation process executed when the trailing end 11*a* of the roll paper is detected is described more specifically next with reference to FIG. 5 and FIG. 6. FIG. 6 is a flow chart for describing the roll paper transportation process when the printer 240 detects the trailing end 11*a* of the roll paper.

As shown in FIG. 5A, the transportation control unit 306 drives the first transportation rollers 51 and the second transportation rollers 52 to advance the roll paper 11 along the transportation path. When the trailing end 11*a* of the roll paper 11 passes the detection position 248*a* of the paper detector 248, the detector control unit 307 determines that the trailing end 11*a* of the roll paper was detected by way of the paper detector 248 (step S11 returns Yes). The transportation control unit 306 causes the stepping motor that is the drive power source to turn the transportation rollers 51 and 52 a predetermined distance after the trailing end 11*a* of the roll paper is detected. This advances the roll paper 11 to the position where the trailing end portion of the roll paper 11 is held between the first transportation rollers 51*a* and 51*b* (step S12). The position of the roll paper 11 at this time is shown in FIG. 5B. The transportation control unit 306 stops the stepping motor at this position to fix the position of the roll paper 11.

As shown in FIG. 5C, when the carriage 23 is not located in the standby position 54, the print control unit 245 drives the carriage 23 to move the carriage 23 to the standby position 54 for capping the print head 21 (step S13). As shown in FIG. 5B, transporting the roll paper 11 stops with the trailing end portion of the roll paper 11 held by the first transportation rollers 51 and the part of the roll paper 11 already conveyed to the downstream side held by the second transportation rollers 52. As a result, a certain amount of tension is applied to the roll paper 11 positioned between the first transportation rollers 51 and the second transportation rollers 52 regardless of how tightly the roll paper 11 is curled. Moving the carriage 23 along the carriage path 53 at this time will not cause a paper jam, for example, because the roll paper 11 will not interfere with carriage 23 movement. Furthermore, because the roll paper 11 will not contact the nozzle surface of the print head 21, the ink meniscus inside the nozzles will not be disturbed and good print quality can be maintained.

If the carriage 23 is already at "the" standby position 54 in step S13, the transportation control unit 306 controls transportation as follows.

After moving the carriage 23 to the standby position 54, the transportation control unit 306 again drives the stepping motor to advance the roll paper 11 to where the trailing end 11*a* of the roll paper is held between the second transportation rollers 52*a* and 52*b* as shown in FIG. 5D.

The transportation control unit 306 then stops the stepping motor to fix the position of the roll paper 11 and turns the LED indicator 6 on (step S15). Turning the LED indicator 6 on informs the user that there is no more roll paper 11. The user can also easily remove the roll paper 11 remaining in the transportation path because the motor was stopped with the trailing end 11*a* of the roll paper held by the second transportation rollers on the downstream side.

This embodiment of the invention turns the LED indicator 6 on after the trailing end 11*a* of the roll paper is held by the second transportation rollers 52. Alternatively, the LED indicator 6 could be turned on while the first transportation rollers 51 continue to hold the roll paper 11 after the first transportation rollers 51 grip the trailing end 11*a* or near the trailing end of the roll paper 11 and the carriage 23 is moved.

If the carriage 23 is not at the standby position 54 when the trailing end 11*a* of the roll paper is detected, the printer 240 according to this embodiment of the invention moves the carriage 23 to the standby position 54 with the roll paper 11 held between the first transportation rollers and second transportation rollers and tension applied to the roll paper 11 located between the first transportation rollers and second transportation rollers. As a result, the ink meniscus inside the nozzles will not be disrupted and consistent print quality can be maintained after replacing the roll paper because moving the carriage 23 does not cause a paper jam and the roll paper does not touch the surface of the print head 21 on the carriage 23.

The nozzles of the print head 21 can also be protected because the carriage 23 is quickly moved to the standby position 54 before the trailing end 11*a* of the roll paper is held between the second transportation rollers 52.

Yet further, because paper transportation stops when the trailing end 11*a* of the roll paper is held by the second transportation rollers 52 at the furthest downstream end of the transportation path, even the shortest trailing end of roll paper can be left inside the paper transportation path without the roll paper falling out of the printer 240. In addition, because only the end 11*a* of the paper is held, the user can smoothly remove the remaining roll paper 11 to install a new roll of paper.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a transportation mechanism for conveying a rolled print medium through a transportation path with the rolled print medium having a trailing end;

a print head for printing images on the print medium;

a carriage for carrying the print head while being adapted to move along a carriage path in a direction transverse to the transportation path;

a paper detector for detecting the trailing end of the print medium which represents an end of the rolled print medium having little remaining roll print medium;

wherein said transportation mechanism comprises first transportation rollers disposed on an upstream side of the carriage path and second transportation rollers disposed on a downstream side of the carriage path; and a drive control unit responsive to a computer and to said paper detector for driving the carriage while directing the transportation mechanism to move the print medium in synchronism with movement of the carriage along the carriage path such that when the paper detector detects the trailing end of the print medium the print medium is advanced a predetermined distance and is then stopped at a fixed position with the trailing end of the print medium held by either the first or second transportation rollers upstream or downstream of the carriage path so that the print medium cannot interfere with further carriage movement.

2. The printer described in claim 1, wherein when the paper detector detects the trailing end of the print medium, the drive control unit moves the carriage to a standby position in which no contact occurs between the print head and the print medium with the trailing end of the print medium held by the first transportation rollers while the print medium is also held by the second transportation rollers.

3. A control method for use in a printer that prints images on a rolled print medium for controlling the transportation of the print medium through a transportation path and for driving a print head carried on a carriage along a carriage path transverse to the transportation path, with the rolled medium having a trailing end defining an end of the rolled print medium having little remaining roll print medium and having a transportation mechanism with first and second transportation rollers for conveying the rolled print medium through the transportation path with the first transportation rollers disposed on an upstream side of the carriage path and with the second transportation rollers disposed on a downstream side of the carriage, the control method comprising steps of:

detecting the trailing end of the print medium; and upon detecting the trailing end advancing the print medium a predetermined distance and then stopping the print medium at a fixed position with the trailing end of the print medium held by either the first or second transportation rollers either upstream or downstream of the carriage path so that the print medium cannot interfere with further carriage movement.

4. The printer control method described in claim 3, wherein when the trailing end of the print medium is detected, the print medium is advanced and stopped at a position where the print medium is held by the first transportation rollers, the carriage is then moved to a standby position in which no contact occurs between the print head and the print medium while the carriage is moved, and the print medium is then advanced and stopped at a position where the trailing end of the print medium is held by the second transportation rollers.

* * * * *